US005199726A

United States Patent [19]

Willett

[11] Patent Number: 5,199,726

[45] Date of Patent: Apr. 6, 1993

[54] FOOT ATTACHED ROLLERSKATE OR SIMILAR ARTICLE AND ASSEMBLY METHOD THEREFOR

[75] Inventor: William Willett, Orange, Calif.

[73] Assignee: Mattel, Inc., El Segundo, Calif.

[21] Appl. No.: 823,398

[22] Filed: Jan. 21, 1992

[51] Int. Cl.[5] ..... A63C 1/04

[52] U.S. Cl. ..... 280/11.27; 36/112; 36/115; 280/611

[58] Field of Search ..... 36/112, 115, 137, 138, 36/15, 117, 50.1, , 50.5, 1; 280/11.19, 11.22, 11.27, 11.3, 611

[56] References Cited

U.S. PATENT DOCUMENTS

| | | | |
|---|---|---|---|
| 1,790,423 | 1/1931 | Hooks . | |
| 2,051,000 | 8/1936 | Heppner . | |
| 3,086,788 | 4/1963 | Vislocky . | |
| 4,126,323 | 11/1978 | Scherz | 36/115 X |
| 4,286,806 | 9/1981 | Bergstein . | |
| 4,351,537 | 9/1982 | Seidel | 280/11.12 |
| 4,363,502 | 12/1982 | Bakerman . | |
| 4,394,037 | 7/1983 | Kuntz . | |
| 4,510,703 | 4/1985 | Eiteljorg | 36/117 X |
| 4,648,610 | 3/1987 | Hegyi . | |
| 4,666,168 | 5/1987 | Hamill et al. | 280/11.2 |
| 4,823,484 | 4/1989 | Couty | 36/50.5 X |
| 4,834,407 | 5/1989 | Salvo . | |
| 5,028,058 | 7/1991 | Olson . | |

*Primary Examiner*—Margaret A. Focarino
*Assistant Examiner*—Michael Mar
*Attorney, Agent, or Firm*—Roy A. Ekstrand

[57] ABSTRACT

A sparking rollerskate includes a clam shell like shoe portion and a wheel assembly. The wheel assembly supports a plurality of rolling wheels together with an internal flint supporting mechanism. One of the skate wheels further includes an abrasive drum which receives the end portion of the flint to provide a spark producing action as the wheel is rotated. The wheel assembly and clam shell like shoe portion are configured to provide a captivating attachment of the wheel assembly to the shoe portion when the clam shell halves thereof are closed. The shoe portions define internal cavities which captivate the wearer's foot during the assembly process to facilitate attachment of the roller skate thereto.

9 Claims, 2 Drawing Sheets

FOOT ATTACHED ROLLERSKATE OR SIMILAR ARTICLE AND ASSEMBLY METHOD THEREFOR

FIELD OF THE INVENTION

This invention relates generally to rollerskates and particularly to assembly methods used therein.

BACKGROUND OF THE INVENTION

Rollerskating has proven to be an extremely popular and long lasting sport and amusement activity through the years. Rollerskating is enjoyed extensively among virtually all children and adults. In the early versions of rollerskates, the typical structure included a foot supporting platform which in turn supported a pair of transversely oriented axles each supporting a pair of freely rolling wheels yielding a stable rectangular arrangement of skate wheels for each skate. Rollerskates have been provided using structures which attach to the wearer's shoe through a clamping arrangement and in shoeskate versions in which a dedicated shoe or boot is integrally secured to the skating platform.

In recent years, a different structure of rollerskate has emerged in which the rolling wheels are supported in an in-line arrangement rather than the rectangular arrangement of earlier skates. This in-line skate has provided a skating action which is somewhat like ice-skating and, at the same time, somewhat like rollerskating.

In both types of rollerskates, the shoe portion resembles a high boot adapted to receive the wearer's foot and a mechanism such as lacing, multiple buckles or hook and loop fabric attachments which permit the boot to be opened to receive the foot and tightened to secure the skate to the wearer's foot.

Manufacturers of childrens' toy dolls often find successful products can be achieved by facilitating a doll action which mimics the actual activities of children and adults. In the case of rollerskates, this situation has proven to be extremely successful. Doll manufacturers have provided a great variety of dolls which either skate alone or which can be fitted with rollerskates and manipulated by the child user. The recent emergence of in-line skates has been mirrored in the skating dolls provided by manufacturers.

Several problems, however, are encountered when employing both conventional rectangular arranged rollerskates and in-line rollerskates for use on dolls. One problem is found in the assembly or attachment of the rollerskate to the doll. In essence, doll's feet and ankles are seldom sufficiently articulated to move into a shoe receptacle in the manner achieved by actual human wearers. Another problem arises out of the ever present need to maximize the play value or excitement which all toys including skating dolls are subjected to.

In their desire to provide a successful rollerskating doll, practitioners in the art have developed a great number of skating dolls and skates for use therewith. For example, U.S. Pat. No. 1,790,423 issued to Hooks sets forth a ROLLERSKATE in which a conventional rollerskate includes at least one wheel equipped with an abrasive outer disk. A flint support member comprises an elongated spring metal structure supported in a non-rotating fashion to urge a pair of conventional flints against the abrasive disk. As the skater skates, the disk rotates with the skate wheel against the flints and provides a sparking action.

U.S. Pat. No. 2,051,000 issued to Heppner sets forth an SIREN EQUIPPED ROLLERSKATE in which an otherwise conventional rollerskate supports a siren sound producing element having a rotating drive wheel coupled thereto. The siren unit is pivotally supported proximate the rear skates wheels and is movable to engage the drive wheel thereof with the rotating skate wheels and energize the siren unit.

U.S. Pat. No. 3,086,788 issued to Vislocky sets forth a SPARKING ATTACHMENT FOR ROLLERSKATE in which an abrasive disk is supported upon the interior vertical surface of a skate wheel. An axle attachment mechanism is secured to the skate axle proximate the abrasive disk and supports an extending flint which is forced against the abrasive disk to provide sparking action during skating.

U.S. Pat. No. 4,286,806 issued to Bergstein sets forth an ROLLER SKATING SPARK GENERATOR having an auxiliary rolling wheel supporting an abrasive drum therebetween. The rolling wheel is supported just above the plane of the skate wheels and a resilient flint support urges a flint against the abrasive drum. The auxiliary wheel and abrasive drum remain motionless and removed from the skate surface until the skater pivots his or her heel upwardly raising the toe wheels of the skate and engaging the auxiliary wheels to rotate the drum against the flint and produce sparks.

U.S. Pat. No. 4,363,502 issued to Bakerman sets forth an ILLUMINATIVE SKATE WHEEL rotatably mounted upon a skate axle and having illumination means enclosed therein.

U.S. Pat. No. 4,394,037 issued to Kuntz sets forth an SPARK GENERATING ROLLERSKATE ASSEMBLY having a pair of abrasive disks supported upon the interior surfaces and inwardly facing therefrom of a pair of skate wheels. A flint support extends downwardly between the skate wheels and includes a pair of outwardly extending flint members which engage the abrasive disks.

U.S. Pat. No. 4,648,610 issued to Hegyi sets forth LIGHT EMITTING ROLLERSKATE WHEELS in which a permanent magnet is fixed upon a rollerskate proximate one of the rotating skate wheels. An inductively powered lamp is supported within the skate wheel and is energized to illuminate the lamp as the inductive portion thereof passes through the magnetic field of the permanent magnet during skating.

U.S. Pat. No. 4,834,407 issued to Salvo sets forth a PYROTECHNIC DEVICE FOR A SKATEBOARD in which a plurality of pyrotechnic members are supported upon the rear portion of a skateboard in a downwardly extending manner. The pyrotechnic elements are abraded by the underlying surface such as pavement or the like during skateboard operation to produce sparks.

U.S. Pat. No. 5,028,058 issued to Olson sets forth a HUB AND BRAKE ASSEMBLY FOR IN-LINE ROLLER SKATE in which a foot receiving shoe and skate assembly are combined to support a plurality of rolling skate wheels in an in-line arrangement. A brake member is supported upon the rear portion of the wheel support mechanism and extends downwardly to provide a high friction braking member.

While the foregoing described prior art rollerskates and rollerskating dolls have in some cases enjoyed commercial success and improved the state of the art for skating dolls, there remains a continuing need for evermore improved and exciting rollerskates and methods of assembly therefor.

SUMMARY OF THE INVENTION

Accordingly, it is a general object of the present invention to provide an improved rollerskate and assembly method therefor. It is a more particular object of the present invention to provide an improved rollerskate and assembly method therefor which facilitates the assembly thereof to a wearer's foot. It is a still more particular object of the present invention to provide an improved rollerskate and assembly method therefor which meets the needs of attachment to a doll's foot.

In accordance with the present invention, there is provided a rollerskate to be received upon a wearer's foot comprises: a shoe having matable half portions; a wheel assembly attachable to the shoe and having a plurality of supporting wheels; and closure means on the half portions cooperating to secure the half portions when mated to captivate the wearer's foot within the shoe.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several Figures of which like reference numerals identify like elements and in which:

DESCRIPTION OF THE PREFERRED EMBODIMENTS

Figures 1, 2, 2A:
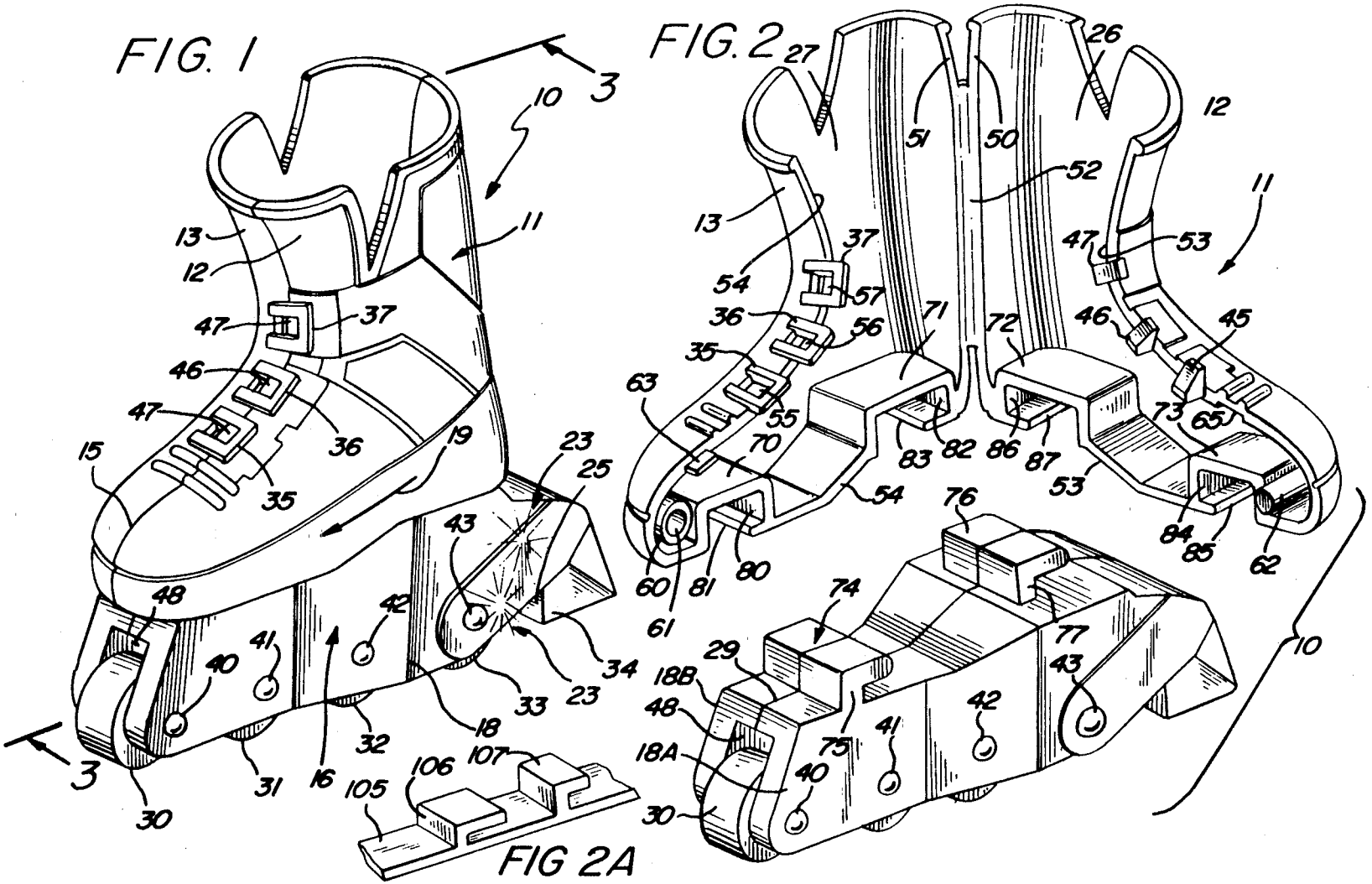
FIG. 1 sets forth a perspective view of a rollerskate constructed in accordance with the present invention.
FIG. 2 sets forth a perspective assembly view of a rollerskate constructed in accordance with the present invention.
FIG. 2A sets forth a perspective view of an alternate embodiment of the present invention adapted to accommodate a ski.

FIG. 1 sets forth a perspective view of an in-line rollerskate constructed in accordance with the present invention and generally referenced by numeral 10. Rollerskate 10 includes a shoe 11 configured to receive the wearer's foot in the manner set forth below and defining a foot receptacle 17 (better seen in FIG. 3). In accordance with an important aspect of the present invention, shoe 11 defines a pair of matable half portions 12 and 13 which meet along a rear seam 14 and front seam 15 in the manner set forth below in greater detail. In further accordance with the present invention, half portion 13 defines a plurality of generally U-shaped buckle clasps 35, 36 and 37 extending laterally from half portion 13 and traversing seam 15. Half portion 12 defines a corresponding plurality of outwardly extending buckle posts 45, 46 and 47 approximate seam 15 which are arranged and configured to be receivable within buckle clasps 35, 36 and 37 to provide a secure attachment between half portions 12 and 13.

A wheel assembly 16 includes a wheel housing 18 which in accordance with the present invention and by means set forth below in greater detail is removably securable to shoe 11. Wheel 16 further includes a plurality of skate wheels 30, 31, 32 and 33 arranged in a linear arrangement. Wheel assembly 16 further includes a corresponding plurality of axles 40, 41, 42 and 43 generally concentric with wheels 30 through 33 respectively. An extending downwardly oriented brake member 34 is supported at the rear of wheel housing 18 and is configured in general correspondence to the "heel brake" often provided on in-line skates.

For reasons of economy of manufacture and ease of assembly set forth below in greater detail, wheels 30 and 33 provide the complete support for rollerskate 10 while wheels 31 and 32 are merely simulated wheels and are not necessary for supporting skate 10. Thus, in their preferred form, simulated wheels 31 and 32 are integrally formed with wheel housing 18 and are raised slightly with respect to wheels 30 and 33 to avoid contact with the supporting surface upon which rollerskate 10 is rolled.

In accordance with a further aspect of the present invention set forth below in great detail, rollerskate 10 includes a spark producing mechanism operative in response to the rotation of wheel 33. Thus, in accordance with the present invention as skate 19 is moved, for example, forwardly in the direction indicated by arrow 19, the sparking mechanism described below in greater detail produces a plurality of spark scintillations 23 and 24. In its preferred form, wheel housing 18 is fabricated of a molded material such as plastic having a sufficient transparency or translucence to permit the observance of sparks 23 occurring within the interior of wheel housing 18. In addition, wheel housing 18 defines a downwardly extending gap 25 between brake 34 and wheel 33 which facilitates the creation of outwardly moving sparks 24 when rollerskate 10 is moved with sufficient velocity. Thus, rollerskate 10 provides a dramatic and exciting play pattern in which the rear portion of wheel housing 18 is illuminated by scintillated sparks 23 and trails emerging sparks 24 near gap 25 as rollerskate 10 is moved rapidly across a play surface. As will be apparent to those skilled in the art, rollerskate 10 is intended to be used in combination with a similar or identical rollerskate on the wearer's other foot in which case the dramatic sparking effect is increased by the simultaneous spark production of both rollerskates.

FIG. 2 sets forth a perspective assembly view of rollerskate 10 showing shoe 11 in the open position and showing wheel assembly 16 prior to assembly within shoe 11. As described above, shoe 11 is formed of a pair of matable half portions 12 and 13 which join to form a foot receptacle 17 and closed seams 14 and 15. Half portion 12 defines an interior cavity 26, a rear edge 50 and a front edge 53. A plurality of buckle posts 45 through 47 are formed upon half portion 12 and extend outwardly from edge 53. Half portion 12 further defines an extending generally cylindrical index post 62 and a pair of foot supporting platforms 72 and 73 within cavity 26. In accordance with an important aspect of the present invention, half portion 12 further defines a pair of generally rectangular channels 84 and 86 each having downwardly facing slots 85 and 87.

Half portion 13 defines an interior cavity 27, a rear edge 51 and a front edge 54. Half portion 13 further defines a plurality of extending U-shaped buckle clasps 35, 36 and 37 each having an inwardly extending generally rectangular notch 55, 56 and 57 respectively. Notches 55 through 57 are configured to receive buckle posts 45 through 47 respectively when half portions 12 and 13 are closed together as shown in FIG. 1. Half portion 13 further defines an extending generally cylindrical index boss 60 having a cylindrical bore 61 extending therein. Index boss 60 is spaced in correspondence with index post 62 and bore 61 is sized so as to receive index post 62 and provide for secure attachment between half portions 12 and 13. In addition, half portion 13 includes a tab 63 extending outwardly from edge 54 while half portion 12 defines an alignment notch 65 located in correspondence with and configured to receive tab 63 when half portions 12 and 13 are closed together. Half portion 13 further defines a pair of planar foot platforms 70 and 71 and a pair of rectangular channels 80 and 82 each of which defines elongated downwardly facing slots 81 and 83 respectively. A hinge 52 extends between edges 50 and 51 of half portions 12 and 13 to provide convenient closure and opening therebetween. In the preferred form of the invention, half portions 12 and 13 as well as hinge 52 are integrally formed of a single molded plastic part or the like in which hinge 52 forms a hinge of the type often referred to as a "living hinge".

Wheel assembly 16 supports wheels 30 through 33 in the manner described above and includes a downwardly extending brake 34. For ease of assembly, it has been found convenient to fabricate wheel housing 18 of wheel assembly 16 as separate housing portions 18A and 18B which may be joined by conventional attachment means such as sonic welding or adhesives or the like. In any event, wheel housing 18 further includes a pair of upwardly extending generally rectangular webs 75 and 77 which in turn support a pair of horizontally disposed attachment claws 74 and 76 respectively.

In accordance with the present invention, webs 75 and 77 are spaced apart and sized to be received within slots 81 and 83 of half portion 13 and slots 85 and 87 respectively of half portion 12. Similarly, claws 74 and 76 are sized and configured to be received within channels 80 and 82 of half portion 13 and channels 84 and 86 of half portion 12.

Thus, assembly of rollerskate 10 may be carried forward in accordance with the present invention by initially installing wheel assembly 16 into either of half portions 12 or 13 by, for example, initially installing wheel housing 16 such that claws 74 and 76 are received within channels 80 and 82 respectively of half portion 13. Continuing this example, half portion 12 is then pivoted about hinge 52 bringing index post 62 in alignment with bore 61 of boss 60 and bringing alignment tab 63 into alignment with notch 65. When so positioned, claws 74 and 76 are aligned with channels 84 and 86 of half portion 12 respectively. In addition, buckle clasps 35 through 37 are aligned with buckle posts 45 through 47. In the next assembly step, half portions 12 and 13 are forced together driving index post 62 into bore 61, tab 63 into notch 65 and forcing buckle clasps 35 through 37 upwardly and buckle posts 45 through 47 downwardly until posts 45 through 47 are received within notches 55 through 57 respectively.

At this point, this assembly of rollerskate 10 is generally complete and wheel assembly 16 is captivated in secure attachment to shoe 11 in the manner shown in FIG. 1.

Thus, with this understanding of the assembly of rollerskate 10, an important advantage of the present invention may now be understood. The method of assembly described above by which half portions 12 and 13 may be initially positioned in the open manner shown in FIG. 2 facilitates the shoe 11 and wheel housing 16 upon the wearer's foot in the manner shown in FIG. 3. Specifically, with shoe 11 in the open position prior to the above-described assembly, either of half portions 12 or 13 are positioned upon the wearer's foot in the manner shown in FIG. 3. For example, with shoe 11 in the open position shown in FIG. 2, the user's foot may be inserted into cavity 27 of half portion 13 such that the underside of the user's foot rests upon platforms 70 and 71. Thereafter, the above described assembly process is carried forward resulting captivating the wearer's foot within cavities 26 and 27 of half portions 12 and 13 respectively in the manner shown in FIG. 3. It will be apparent to those skilled in the art that the present invention roller skate and assembly method is particularly advantageous for use in combination with toy dolls which typically have unarticulated rigid foot ankle and lower leg appendages and are thus difficult to place within a miniature shoe or the like. It is contemplated, however, that the present invention roller skate and assembly method therefor need not necessarily be limited to a toy rollerskate assembled to a doll's foot but may find application with actual full sized rollerskates worn by human skaters. For example, certain human skaters may have injury or disfunction to portions of their foot which make wearing of a conventional skate difficult or perhaps even impossible.

Once rollerskate 10 is assembled in the manner described above, several options of assembly are presented which facilitate meeting different user needs. For example, in the absence of attachment between edges 53 and 54 and edges 50 and 51 respectively, half portions 12 and 13 may be removed from the wearer's foot by simply separating buckle clasps 35 through 37 from buckle posts 45 through 47. In such case, the above described assembly may be reversed and rollerskate 10 removed from the wearer's foot and applied to a different wearer's foot or reapplied at the user's choice. Conversely, it may be desirable in the manufacture of skating dolls to complete the above-described assembly by permanent attachment between half portions 12 and 13 and preclude removal of roller skate 10 for various reasons such as safety or the like. In such case, the above-described assembly is completed by simply providing a conventional attachment between edges 53 and 54 and edges 50 and 51 respectively such as adhesive attachment or sonic welding or the like.

It will be apparent to those skilled in the art that while the embodiment shown in FIGS. 1 and 2 for the present invention is that of a rollerskate, the present invention may be practiced on a variety of weight bearing shoe appliances such as ice-skates or skis or the like. Thus, for example, and with reference to FIG. 2A, a generally conventional ski 105 includes a pair of attachment means 106 and 107 configured to be received within channels 80 and 82 of half portion 13 and channels 84 and 86 of half portion 12 in the same manner in which wheel assembly 16 is received. Thus, it will be apparent that a variety of weight bearing articles may be used in accordance with the present invention.

Figure 3:
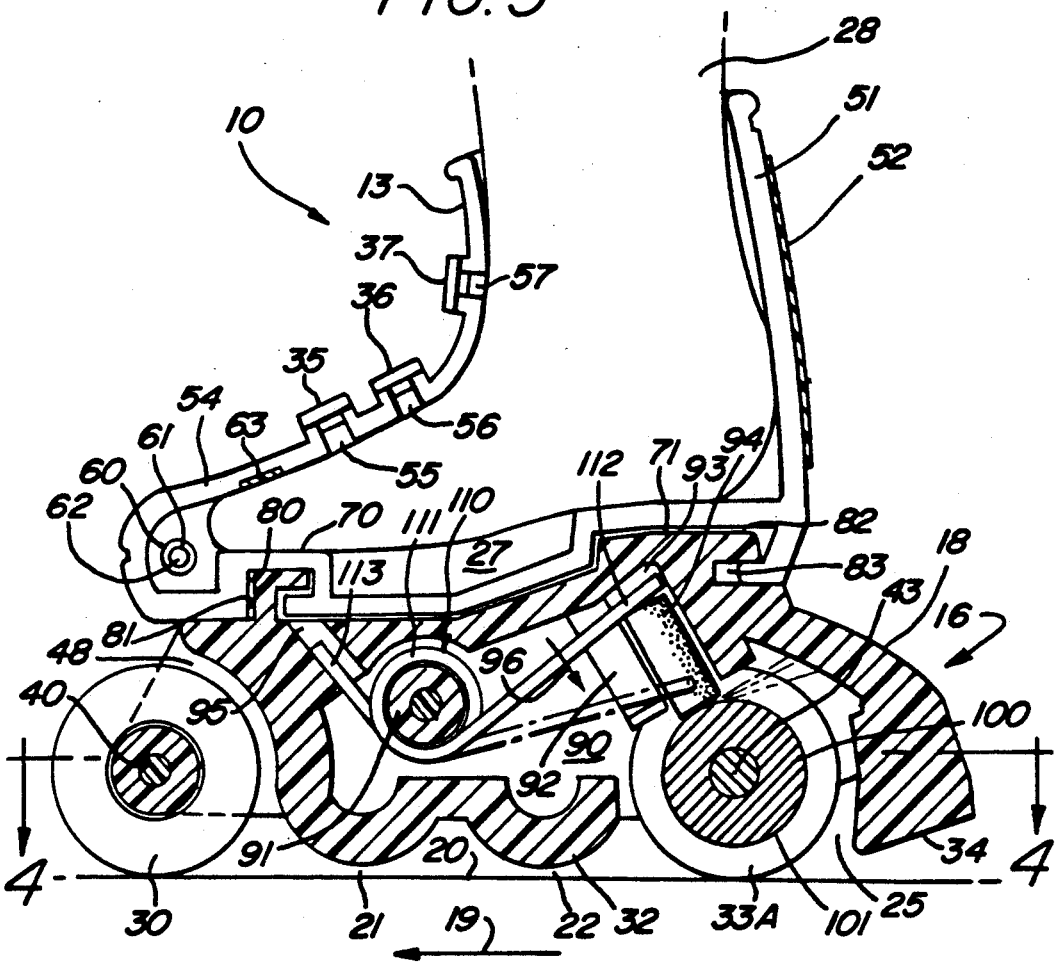
FIG. 3 sets forth a section view of the present invention rollerskate taken along section lines 3—3 in FIG. 1.

FIG. 3 sets forth a section view of the present invention roller skate taken along section lines 3—3 in FIG. 1. As described above, rollerskate 10 includes a half portion 13 defining a interior cavity 27, a pair of platforms 70 and 71, a rear edge 51 and a front edge 54. Front edge 54 defines extending buckle clasps 35 through 37 having interior notches 55 through 57 respectively. A hinge 52 joins half portion 13 to half portion 12 in the manner shown in FIGS. 1 and 2. Half portion 13 further defines a pair of channels 80 and 82 which in turn defines slots 81 and 83 respectively. A user's foot 28 is received within cavity 27 and captivated within cavity 26 of half portion 12 in the above-described assembly process. Half portion 13 further defines a cylindrical index boss 60 having a cylindrical bore 61 therein. In the above-described assembly, post 62 of half portion 12 (seen in FIG. 2) is received within bore 61 and provides attachment therebetween. As is also described above, half portion 13 defines an extending alignment tab 63 which, as described above, is received within a corresponding notch 65 in half portion 12 (seen in FIG. 2).

A wheel assembly 16 includes a wheel housing 18 defining a wheel well 48 and an interior cavity 90. Wheel housing 18 further defines a spring guide 92 and a flint channel 93. Flint channel 93 receives an elongated flint 94. Wheel housing 18 further defines a passage 95 and a generally cylindrical spring post 91. Spring post 91 extends transversely through interior cavity 90 of housing 18. A spring 110 includes a coiled portion 111 which is received upon cylindrical post 91, an end portion 113 which is received within passage 95, and an elongated end portion 112. The latter extends across spring guide 92 and into flint channel 93.

As is set forth above, wheel 33 is supported within wheel housing 18 by an axle 43. In its preferred form, however, wheel 33 comprises a pair of spaced apart wheel portions 33A and 33B together with a cylindrical abrasive drum 100 extending therebetween (better seen in FIG. 4). Abrasive drum 100 defines an abrasive outer surface 101 and is secured to and rotatable with wheel portions 33A and 33B of wheel 33. An elongated flint 94 is captivated between end portion 112 of spring 110 and the underlying area of abrasive surface 101 of drum 100. Spring 110 provides a spring force urging end portion 112 in the clockwise direction indicated by arrow 96 and thus forces flint 94 against abrasive surface 101 of drum 100.

As is also mentioned above for reasons such as ease of assembly and economy of production, wheels 31 and 32 are simulated wheel portions which do not roll and which are raised from wheels 30 and 33 such that when skate 10 rests upon a flat surface such as surface 20, spaces 21 and 22 exist between wheels 31 and 32 to prevent surface contact.

In operation, foot 28 and skate 10 are moved across surface 20 as, for example, in the direction indicated by arrow 19 causing a rotation of wheel 33 and thereby drum 100 against the end portion of flint 94. The urging force of spring 110 against flint 94 and the abrasive character of abrasive surface 101 cooperate to cause a plurality of sparks to be produced by the rolling action of rollerskate 10. It will apparent those skilled in the art that sparking action may be obtained in either direction of motion so long as it results in rotation of wheel 33.

Figure 4:
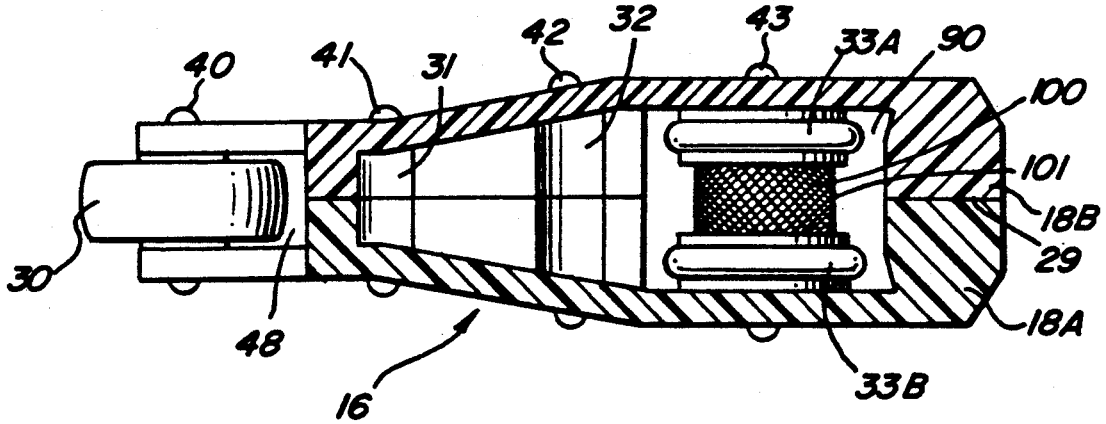
FIG. 4 sets forth a section view of the present invention rollerskate take along section lines 4—4 in FIG. 3.

FIG. 4 sets forth a section view of the present invention rollerskate and assembly method therefor taken along section lines 4—4 in FIG. 3. Wheel assembly 16 defines a wheel well 48 and an internal cavity 90. In the manner described above, a rotatable wheel 30 is supported within wheel well 48 by an axle 40. Within cavity 90, a compound wheel 30 having wheel portions 33A and 33B together with an interposed cylindrical drum 100 is rotatably supported by an axle 43. Drum 100 includes an abrasive surface 101 to provide the above-described action of rollerskate 10. In its preferred form, wheel portions 33A and 33B are formed of a resilient high friction material such as rubber or the like to provide a maximum frictional grip against the roller surface such as surface 20 shown in FIG. 3 to assure proper rotation of drum 100 and a maximum of spark producing action. It will be apparent to those skilled in the art that will wheel assembly 16 is shown having axles 40 and 43, a substantial increase in economy of production is enjoyed by fabricating the supporting axles for wheels 30 and 33 as integral parts of wheel housing 18. Thus, in accordance with the preferred fabrication of wheel assembly 16, wheel housing 18 is formed of a pair of mating housing portions 18A and 18B which are joined along a common seam 29. The fabrication of housing 18 in this manner greatly facilitates the assembly and installation of wheels 30 and 33 as well as flint 94 and spring 110 (seen in FIG. 3). Portions 18A and 18B may be removably secured using conventional fastening apparatus (not shown) to facilitate the replacement of flint 94 or alternatively may be permanently attached using sonic welding, adhesive attachment, or the like.

What has been shown is an improved sparking rollerskate and assembly method therefor which is fabricated using relatively few parts and may be formed primarily using molded plastic parts enjoying substantial economy of manufacture. The fabrication of the shoe portion of the present invention rollerskate in a "clam shell" like structure greatly facilitates the assembly of the roller skate and its application and attachment to the wearer's foot. The present invention rollerskate and assembly method therefor while applicable to conventional rollerskates, both in-line and rectangularly configured, is believed to enjoy particular advantage in the assembly to a rigid foot such as that provided by many dolls or the like.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A sports article to be received upon a wearer's foot comprising:

a shoe having upper and lower portions and formed by matable half portions joined by a vertically extending common hinge and movable between an open position and a closed mated position;

a weight bearing assembly attachable to said shoe and having a housing and surface contacting means attached to said housing weight support;

attachment means for releasably coupling said weight bearing assembly to said shoe including means located on the lower portion of each of said half portions for engaging means located on said housing when said half portions are in said closed position;

closure means on said half portions cooperating to secure said half portions in said closed mated position to captivate said weight bearing assembly and said wearer's foot.

2. A sports article as set forth in claim 1 wherein said shoe defines at least one interior channel and wherein said weight bearing assembly includes at least one extension receivable within said at least one channel before said half portions are mated and captivated therein once said half portions are mated.

3. A rollerskate to be received upon a wearer's foot comprising:

a shoe having upper and lower portions and formed by matable half portions joined by a vertically extending common hinge and movable between an open position and a closed mated position;

a wheel assembly having a wheel housing and a plurality of supporting wheels;

attachment means for coupling releasably said wheel assembly to said shoe including means located on the lower portion of each of said half portions for engaging means located on said wheel housing when said half portions are in said closed mated position; and closure means on said half portions cooperating to secure said half portions in said closed mated position to captivate said wheel assembly and said wearer's foot.

4. A rollerskate as set forth in claim 3 wherein said shoe defines at least one interior channel and wherein said wheel assembly includes at least one extension receivable within said at least one channel before said half portions are mated and captivated therein once said half portions are mated.

5. A rollerskate as set forth in claim 4 wherein said shoe defines first and second interior channels and wherein said wheel assembly includes first and second extensions received respectively in said first and second channels.

6. A rollerskate as set forth in claim 5 wherein said wheel assembly includes spark producing means coupled to and operated by at least one said supporting wheels.

7. A rollerskate as set forth in claim 5 wherein said shoe includes hinge means coupled between said half portions and wherein said half portions are pivotable about said hinge means between a closed position in which they mate and an open unmated position.

8. A rollerskate as set forth in claim 7 wherein said half portions define cooperating index and alignment means operative to aid in the mating of said half portions in said mated position.

9. A rollerskate as set forth in claim 3 wherein one of said wheels within said wheel assembly includes a drum defining an abrasive surface and wherein said wheel assembly includes:

a flint supporting channel;

a flint supported within said channel; and spring means urging said flint against said abrasive surface.

* * * * *